United States Patent [19]

Komarov et al.

[11] 4,125,134

[45] Nov. 14, 1978

[54] WEAVING MECHANISM OF A WAVE-TYPE SHEDDING LOOM

[76] Inventors: Jury I. Komarov, ulitsa Miklukho-Maklaya, 29, korpus 1, kv. 215; Alexei N. Parshin, Nagornaya ulitsa, 34, korpus 43, kv. 53; Dmitry V. Titov, 13 Parkovaya ulitsa, 27, korpus 2, kv. 49, all of Moscow, U.S.S.R.

[21] Appl. No.: 858,855

[22] Filed: Dec. 8, 1977

[30] Foreign Application Priority Data

Dec. 23, 1976 [SU] U.S.S.R. ..... 2433205

[51] Int. Cl.[2] ..... D03D 47/26

[52] U.S. Cl. ..... 139/436

[58] Field of Search ..... 139/188, 191, 436

[56] References Cited

U.S. PATENT DOCUMENTS

| | | | |
|---|---|---|---|
| 3,895,654 | 7/1975 | Welzel et al. | 139/436 |
| 3,990,484 | 11/1976 | Steiner | 139/436 |

*Primary Examiner*—Henry S. Jaudon

*Attorney, Agent, or Firm*—Steinberg & Blake

[57] ABSTRACT

The invention relates to weaving mechanisms and can be used to advantage in wave-type shedding looms. The mechanism includes a plurality of toothed discs mounted in a staggered fashion on a shaft and defining a helical surface having a portion of a varying radius diminishing axially in the direction of the advancing motion of the helical surface. Underlying the discs are support rollers with lugs defining a helical surface engaging the helical surface defined by the valleys of the discs and likewise having a portion of a varying radius, engaging the corresponding portion of the helical surface defined by the valleys. Such an embodiment simplifies the structure of the mechanism and obviates the need in a drive of the support rollers.

4 Claims, 5 Drawing Figures

WEAVING MECHANISM OF A WAVE-TYPE SHEDDING LOOM

FIELD OF THE INVENTION

The present invention relates to looms, and more particularly to weaving mechanisms incorporated in looms.

The invention can be used to utmost advantage in a wave-type shedding loom, i.e., in a loom where several sheds are formed simultaneously of the warp threads, and the beating-up of a weft thread is effected by toothed discs.

BACKGROUND OF THE INVENTION

At present, there are widely used in the art of weaving such mechanisms which have a reed formed by a plurality of toothed discs, the discs being successively mounted on a shaft in an angularly staggered fashion, so that their teeth and valleys define helical surfaces of the same pitch.

To prevent sagging and vibration of the discs, underlying them are support or back-up rollers engaging the apices of the teeth of the discs.

However, this mode of engagement between the support rollers and the teeth of the discs more often than not results in deformation of the teeth, which affects the quality of the beating-up of the weft threads, and, ultimately, affects the quality of the cloth being woven.

Such deformation of the teeth of the discs can be precluded by having the support rollers with helical lugs defining a helical surface engaging the helical surface defined by the valleys of the discs and having a pitch equalling that of the helical surface defined by the teeth of the discs. Then, in order to provide for proper cloth formation, i.e., for the desired pattern of the motion of the discs of the reed, the support rollers are to be rotated in synchronism with the shaft of the discs, by an individual drive.

However, the incorporation of such a drive complicates the structure of the weaving mechanism. Moreover, in mechanisms of this kind, there is an eventuality of the support rollers slipping relative to the teeth of the discs, should the driving chain of the drive be somehow impaired, which affests the synchronism in the rotation of the shaft of the discs and of the support rollers, with the eventual breakdown of the discs. This, in turn, cannot but affect the quality of the cloth being woven.

BRIEF DESCRIPTION OF THE INVENTION

It is an object of the present invention to provide a weaving mechanism of a wave-type shedding loom, which should have a simple structure.

Another object of the present invention is to provide a weaving mechanism offering facilitated operation and maintenance.

Still another object of the present invention is to provide a weaving mechanism ensuring high quality of the cloth being woven.

These and other objects are attained in a weaving mechanism of a wave-type shedding loom, comprising a reed defined by toothed discs adapted to beat up a weft thread to the fell of the cloth being woven and mounted successively on a shaft in a staggered fashion, so that their teeth and valleys define respective helical surfaces of the same pitch, and support rollers with helical lugs defining a helical surface engaging the helical surface defined by the valleys of the discs and having a pitch equalling the pitch of the helical surface defined by the teeth of the discs, in which mechanism, in accordance with the present invention, the helical surface defined by the valleys of the discs has a portion of a varying radius diminishing axially in the direction of the advancing motion of the helical surfaces of the discs.

Preferably, the portion of the varying radius is of a conical or tapering shape. The provision of the portion of the varying radius provides for synchronous rotation of the shaft of the discs and of the support rollers and enables to restore the rotational speed of the latter, should it vary on account of eventual slipping of these rollers relative to the helical surface defined by the valleys of the discs. This has been made possible by selecting the taper angle of the above portion to correspond to this eventual slip, in which way self-adjustment of the support rollers has been provided for, whereby an individual drive of the support rollers has become redundant. This significantly simplifies the structure of the mechanism, facilitates its operation and maintenance.

To enhance the reliability of operation of the mechanism it is expedient, in accordance with further features of the present invention, that the helical surface defined by the lugs of the support rollers should have a portion of a varying radius, similar to the portion of the varying radius of the helical surface defined by the valleys of the discs, and that the mean radii of the two portions should be equal.

The self-adjustment of the support rollers and the positively maintained synchronism of the rotation of these rollers and of the shaft of the discs become even more dependable when, in accordance with yet another feature of the present invention, each portion of the varying radius of a respective helical surface of the discs and of the support rollers is adjoined by another portion having a cylindrical shape.

BRIEF DESCRIPTION OF THE ACCOMPANYING DRAWINGS

The present invention will be further described in connection with embodiments thereof, with reference being had to the accompanying drawings, wherein.

DETAILED DESCRIPTION OF THE INVENTION

Figure 1:
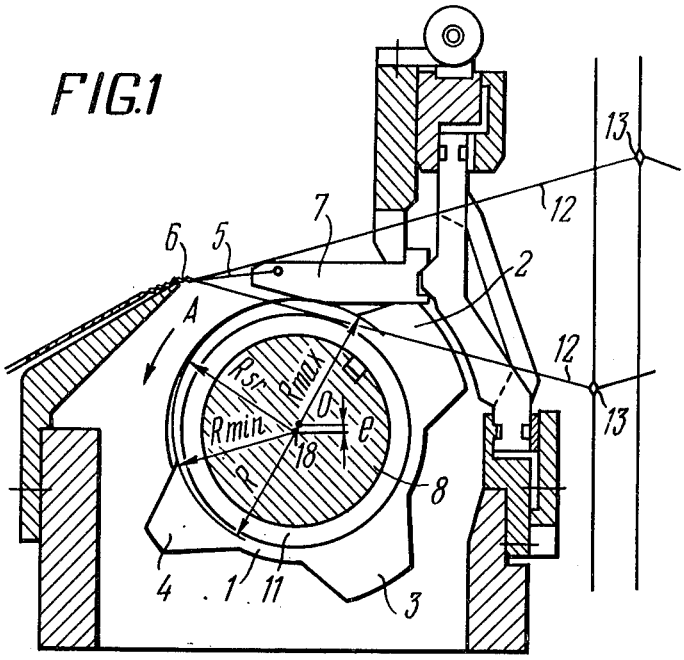
FIG. 1 is a sectional side view of a weaving mechanism in accordance with the invention.
Figure 2:
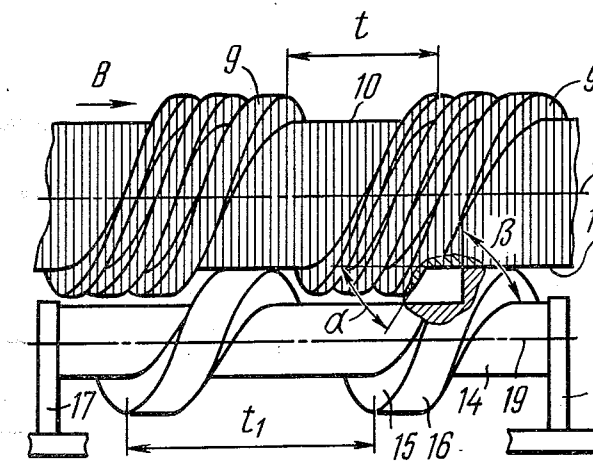
FIG. 2 is a front view illustrating the relative positions of the shaft of the discs and of the support rollers.

Referring now to the drawings, the herein disclosed weaving mechanism comprises a reed defined by discs 1 (FIG. 1) with teeth 2, 3 and 4 intended to move a weft thread 5 and to beat it up to the fell 6 of the cloth being woven. The weft thread 5 is paid off a carrier 7 propelled by the teeth 2 of the discs 1. The latter are mounted in succession on a riven shaft 8 in an angularly staggered fashion so that their teeth 2, 3 and 4 define a helical surface 9 (FIG. 2), while the valleys between the teeth define a helical surface 10, the two helical surfaces 9 and 10 having the same pitch "$t$".

Mounted intermediate the adjacent ones of the discs 1 (FIG. 1) on the shaft 8 are spacer rings 11 intended to provide spaces between the discs, to accommodate warp threads 12 shiftable by healds 13 to form a shed for the travel of the carrier 7 therethrough.

The shaft 8 is associated with any suitable known per se drive means, its direction of rotation being indicated in the drawing by arrow "A".

Figure 3:
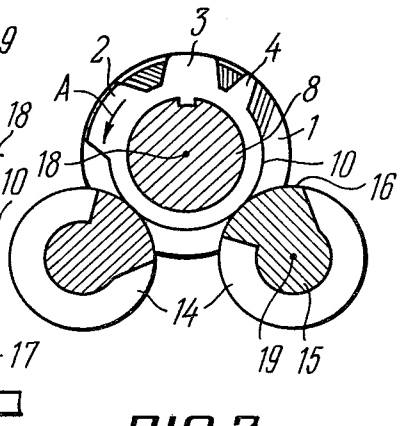
FIG. 3 is a sectional side view of FIG. 2.

To prevent sagging of the drive shaft 8 and vibration of the discs 1 (FIGS. 2 and 3), mounted to underlie the latter are support or back-up rollers 14 having on their surface helical lugs 15 defining the helical surface 16. The surface 16 engages the helical surface 10 defined by the valleys of the discs 1 and has a pitch "$t_1$" equalling the pitch "$t$". The support rollers 14 are mounted in a housing 17 for rotation brought about by the engagement of the helical surfaces 16 and 10, the rotation of the support rollers 14 being thus synchronous with the rotation of the shaft 8 of the discs 1.

To reduce the wear of the teeth 2. . .4 of the discs 1, the radial height of each lug 15 of the support rollers 14 is in excess of the radial depth of the valley between the discs 1.

The slant angle "$\alpha$" of the helical surface 9 with respect to the axis 18 of rotation of the shaft 8 is smaller than the slant angle "$\beta$" of the helical surface 16 with respect to the axis 19 of rotation of the support rollers 14, and this precludes engagement of the apices of the teeth 2, 4 with the surface of the lugs 15, which otherwise might have caused breakdown of the discs 1.

Figure 4:
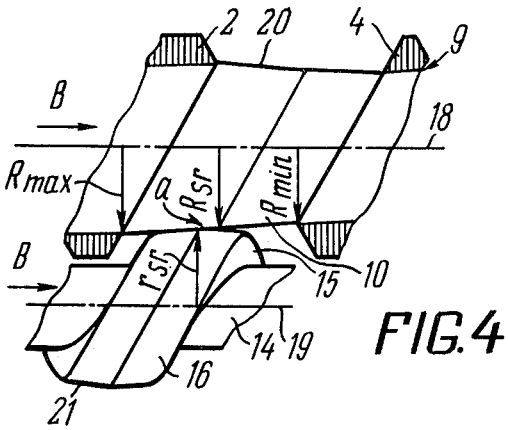
FIG. 4 shows schematically an embodiment of the portions of the helical surfaces defined by the valleys of the discs and by the support rollers.

The helical surface 10 (FIG. 4) defined by the valleys between the teeth 2 and 4 has a portion 20 of a varying radius R which attains values $R_{max}$ corresponding to the maximum radial depth of the valleys, $R_{min}$ corresponding to the minimum radial depth of these valleys, and the mean value $R_m$ intermedite the values $R_{max}$ and $R_{min}$. In the presently described embodiment, the portion 20 has a tapering shape, which is provided for by shaping the helical surface 10 with a radius R (FIG. 1) from a centre "O" offset by a distance "$e$" from the axis 18 of rotation of the shaft 8 toward the tooth 2. This is done in the course of manufacture of the discs 1. Then, with the discs 1 mounted on the shaft 8, there is formed the helical surface 10 defined by the valleys between the teeth, having the tapering portion 20 (FIG. 4) of which the radius R diminishes along the axis 18 in the direction of the advance of the helical surfaces 10 and 9. This advance of the surfaces 10 and 9 is indicated in the drawing with arrow "B".

In the presently described embodiment, the helical surface 16 of the support rollers 14 likewise has a portion 21 of a varying radius "$r$", having a tapering shape. The mean values of the radii $R_m$ and $r_m$ of the two portions 20 and 21, respectively, are equal, whereby self-adjustment of the rollers 14 is provided.

Should the rollers 14 slip in operation, the speed of their rotation diminishes, whereby the helical surface 16 of the lugs 15 becomes displaced parallel to the axis 18 of the shaft 8 relative to the helical surface 10 defined by the valleys, toward the $R_{max}$ portion.

Accordingly, the speed of rotation of the support rollers increases, whereby the displacement of the rollers along the valley toward the greater radius $R_{max}$ is arrested, and the rollers attain such a position between the teeth 2 and 4 whereat the surfaces 10 and 16 engage each other by their respective tapering portions 20 and 21 in the area of the radius $R_{max}$, this radius being in excess of the radius "$r$" of the helical surface 16 defined by the lugs 15 by a value "$a$" corresponding to the slip value.

It has been observed that the value of the slip of the helical surface 16 (FIG. 4) of the lugs 15 at the helical surface 10 defined by the valleys is small, whereby the difference between the values $R_{max}$ and $R_{min}$ can be correspondingly small, e.g. of about 0.2 mm to 0.3 mm.

Figure 5:
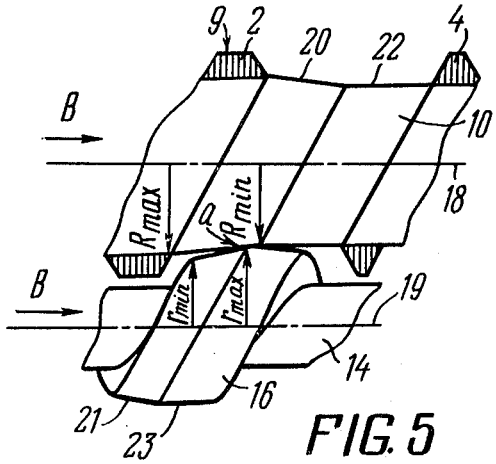
FIG. 5 is another embodiment of the portions of the helical surfaces defined by the valleys of the discs and by the support rollers.

Illustrated in FIG. 5 of the appended drawings is an embodiment wherein each portion 20 and 21 of the respective helical surface 10 and 16 is adjoined by another respective portion 22 and 23, both portions 22 and 23 being of a cylindrical shape. In this embodiment, $R_{min} = r_{max}$.

However, taking into consideration that the slip value is small, and the difference between the radii $R_{max}$ and $R_{min}$ is accordingly small, it is practically feasible to have a single cylindrical portion 23 provided on the helical surface 16 of the lugs 15.

PRINCIPLE OF OPERATION

With the shaft 8 rotated, the discs 1 are rotated thereby, the teeth 2 propelling the carrier 7 of the weft thread 5, and the teeth 3 and 4 beating up the weft thread 5 to the fell 6 of the cloth being woven.

The support rollers 14 having their helical surface 16 engaging the helical surface 10 of the valleys of the discs 1 are also rotated by said engagement, preventing sagging of the driven shaft 8 and vibration of its discs 1.

With the surfaces 10 and 16 engaging each other, they are in contact with their tapering portions 20 and 21, and, owing to the equality of the mean radii $R_m$ and $r_m$ of these respective portions, the support rollers 14 rotate in synchronism with the shaft 8, at the same speed.

Should the rollers 14 slip, their speed of rotation diminishes, i.e., the rollers 14 lag in their rotation behind the shaft 8, and their lugs 15 become displaced by the value "$a$" toward the maximum radius $R_{max}$. This displacement takes place until the speed of rotation of the support rollers 14 equals the speed of rotation of the shaft 8, which is provided for by the interaction of the tapering portions 20 and 21. This self-adjustment of the support rollers 14 in case of their slip ensures their being reliably driven by friction by the valleys of the discs. The greater the slip, the greater the resulting displacement "$a$", but it has been found that for practical reasons a proper mode of the driving of the support rollers 14 is provided for with the difference between $R_{max}$ and $R_{min}$ being as small as 0.2 to 0.3 mm.

In an embodiment wherein the helical surfaces 10 and 16 are provided, respectively, with the portions 20 and 22, 21 and 23, the self-adjustment of the support rollers 14 upon their slipping takes place, as follows.

With the cylindrical portions 22 and 23 engaging each other, the support rollers 14 slow down, owing to the slip, whereby there takes place a displacement along the axis 18 of the shaft 8 toward the greater radius $R_{max}$. Consequently, the tapering portions 20 and 21 come into engagement, i.e., the minimum radius $r_{min}$ engages the maximum radius $R_{max}$. In this way, the speed of rotation of the support rollers 14 is increased, until a moment comes when the relative displacement of the support rollers 14 along the valley toward the greater radius ceases; in other words, there takes place the same process of self-adjustment which has been described above in connection with the embodiment wherein the helical surfaces 10 and 16 have the single tapering portion, either 20 or 21.

The herein disclosed weaving arrangement with the self-adjusting support rollers 14 is simple both in manufacture and in operation, since the manufacture of the helical surfaces 10 defined by the valleys between the teeth of the discs 1 is effected simultaneously with one of the operations of shaping these discs 1 (a pressing operation), while the manufacture of the support rollers 14, e.g. with the helical cylindrical surface 16 of the lugs 15 involves either simple turning operations, or pressure-moulding of the entire rollers from a plastic material.

What is claimed is:

1. A weaving mechanism for a wave-type shedding loom, comprising: a driven shaft; discs with teeth, mounted on said shaft in succession in an angularly staggered fashion so that their teeth and valleys define respective helical surfaces of the same pitch, said discs with the teeth being adapted to beat up a weft thread to the fell of the cloth being woven; a portion of the helical surface defined by the valleys of said discs, having a varying radius diminishing along the axis of rotation of said shaft in the direction of the advance of the helical surfaces; support rollers underlying said discs; helical lugs provided on the surface of said support rollers and defining a helical surface engaging the helical surface defined by the valleys of the discs and having the same pitch therewith.

2. A mechanism as set forth in claim 1, wherein said portion of a varying radius has a tapering shape.

3. A mechanism as set forth in claim 1, wherein the helical surface defined by the lugs of the support rollers likewise has a portion of a varying radius, the respective values of the mean radii of the two portions being equal.

4. A mechanism as set forth in claim 1, wherein each said portion of a varying radius of the respective helical surface is adjoined by another portion of a cylindrical shape.

* * * * *